United States Patent [19]

Todd

[11] Patent Number: 4,568,249

[45] Date of Patent: Feb. 4, 1986

[54] VARIABLE RECIPROCATING PLUNGER PUMP

[76] Inventor: James W. Todd, 102 Birch Dr., Lafayette, La. 70506

[21] Appl. No.: 705,409

[22] Filed: Feb. 25, 1985

Related U.S. Application Data

[63] Continuation of Ser. No. 488,657, Aug. 26, 1983, abandoned.

[51] Int. Cl.[4] ..... F04B 19/00; F04B 39/10

[52] U.S. Cl. ..... 417/238; 417/254; 417/488; 417/568; 92/168

[58] Field of Search ..... 417/238, 214, 568, 488, 417/254, 267; 92/168, 243, 249, 170

[56] References Cited

U.S. PATENT DOCUMENTS

| | | | |
|---|---|---|---|
| 2,185,264 | 1/1940 | Mistral | 417/214 |
| 2,538,842 | 1/1951 | McFarland | 417/287 |
| 2,561,227 | 7/1951 | Reed | 417/238 |
| 2,678,609 | 5/1954 | Ashton | 92/168 X |
| 2,916,998 | 12/1959 | Miller | 417/568 |
| 3,040,712 | 6/1962 | Harrah | 92/170 |
| 3,330,217 | 7/1967 | Baur et al. | 92/256 |
| 3,461,805 | 8/1969 | Karkow | 417/568 |

*Primary Examiner*—Cornelius J. Husar
*Assistant Examiner*—Peter M. Cuomo
*Attorney, Agent, or Firm*—Larson and Taylor

[57] ABSTRACT

A reciprocating plunger pump having variable pumping modes is disclosed. A pump housing having an enclosed pump chamber provided with a valved inlet and a valved outlet is provided. A first plunger having a piston end extending into the pump housing and an outer end extending outside of the housing is driven in a reciprocal motion to produce a pumping action in the pump chamber. A second plunger having an inner end extending into the pump chamber and an outer end located out of the pump chamber is also mounted for reciprocal motion. The second plunger is removably attached to the first plunger. When the two plungers are attached together, a high pressure and low volume pumping of a fluid is achieved. When the two plungers are not attached together, a lower pressure and higher volume pumping of the fluid is achieved. Preferably, both plungers are substantially cylindrically shaped and the piston end of the first plunger is greater in diameter than the inner end of the second plunger. In order to attach the second plunger to the first plunger, a suitable screw projects from the second plunger and is threadably received in the first plunger.

5 Claims, 2 Drawing Figures

VARIABLE RECIPROCATING PLUNGER PUMP

This application is a continuation of application Ser. No. 488,657 filed Aug. 26, 1983, now abandoned.

FIELD OF THE INVENTION

The present invention relates generally to pumps for fluids, and more particularly to a reciprocating plunger pump having variable pumping modes.

BACKGROUND OF THE INVENTION

Reciprocating plunger pumps are well known in the prior art. There are a number of controlling variables associated with the operation of such pumps. These variables include the area of the plunger, stroke length of the plunger (the distance that the plunger travels), the force exerted by the power unit in reciprocating of the plunger, and the number of times the plunger completes a stroke within a given time period. Because the area of the plunger is constant and may not be altered, this factor dictates one maximum pressure which may be obtained when the power unit exerts its maximum force on the plunger. The volume output per stroke is controlled by the area of the plunger times the distance that the plunger travels. The number of strokes per period of time determines the flow of the pump fluid. Although the pressure and volume of the pump fluid can be varied, the variation is limited due to the constant area of the plunger. One method of varying the pressure is by controlling the force exerted by the power unit on the plunger. In order to vary volume, the number of strokes per unit time can be varied by adjusting the speed control of the power unit. The volume output can also be controlled by adjusting the stroke length of the plunger. However, despite these adjustments, large pressure and volume variations cannot be achieved.

There has been disclosed in U.S. Pat. No. 2,047,167 (Heller) an adjustable clearance piston which is used to adjust the clearance space in order to vary the capacity of a compressor. A variable volume clearance device is also disclosed in U.S. Pat. No. 3,045,892 (White). This patent also discloses two shafts which can be coaxially connected.

SUMMARY OF THE INVENTION

In accordance with the present invention, a reciprocating plunger pump having variable pumping modes is provided. The pump includes a pump housing having an enclosed pump chamber, a valved inlet to the pump chamber, and a valved outlet from the pump chamber. A first plunger passes through the housing and has a piston end extending into the pump chamber and an outer end located outside of the pump housing. A suitable motor is attached to the outer end of the first plunger which drives the first plunger in a reciprocating motion. As the first plunger reciprocates along a reciprocation axis, a fluid is pumped into the pump chamber through the inlet and out of the pump chamber through the outlet. A second plunger having an inner end also extending into the pump chamber and an outer end located outside of the pump chamber is mounted for reciprocation along the reciprocation axis of the first plunger. The second plunger is removably attached to the first plunger by a suitable attaching means. When the second plunger is attached to the first plunger, a high pressure and low volume pumping of the fluid is achieved. When the second plunger is detached from the first plunger, a lower pressure and higher volume pumping of the fluid is achieved.

In the preferred embodiment of the present invention, the plungers are cylindrically shaped and the diameter of the piston end of the first plunger is greater than the diameter of the inner end of the second plunger. The second plunger is attached to the first plunger by a screw projecting from the inner end of the second plunger. This screw is received in a threaded hole located in the piston end of the first plunger. The second plunger is mounted for rotation about the reciprotation axis so that the outer end of the second plunger which extends out of the housing is easily gripped to engage or disengage the screw from the threaded hole.

According to the preferred embodiment, the housing is also generally cylindrically shaped and includes two mating cylindrical parts which are suitably attached together. In addition, the valved inlet and valved outlet in the housing are preferably check valves which are threadably received in the housing. A sealing means is also provided around the peripheries of each of the plungers. The inner end of the second plunger is preferably slightly enlarged, and a recess is provided in the pump chamber in which the enlarged portion of the second plunger is received when the second plunger is not attached to the first plunger.

It is a feature of the present invention that two substantially different pumping modes are provided for a single reciprocating plunger pump. In the first mode, a high pressure but low volume of a fluid is pumped. In the second mode, a significantly lower pressure but higher volume of a fluid is pumped.

It is an advantage of the present invention that the pumping modes of the reciprocating plunger pump are easily altered and can be designed for specific ranges.

Other features and advantages of the present invention are stated in or apparent from a detailed description of a presently preferred embodiment of the invention found hereinbelow.

DETAILED DESCRIPTION OF THE PREFERRED EMBODIMENT

Figure 1:
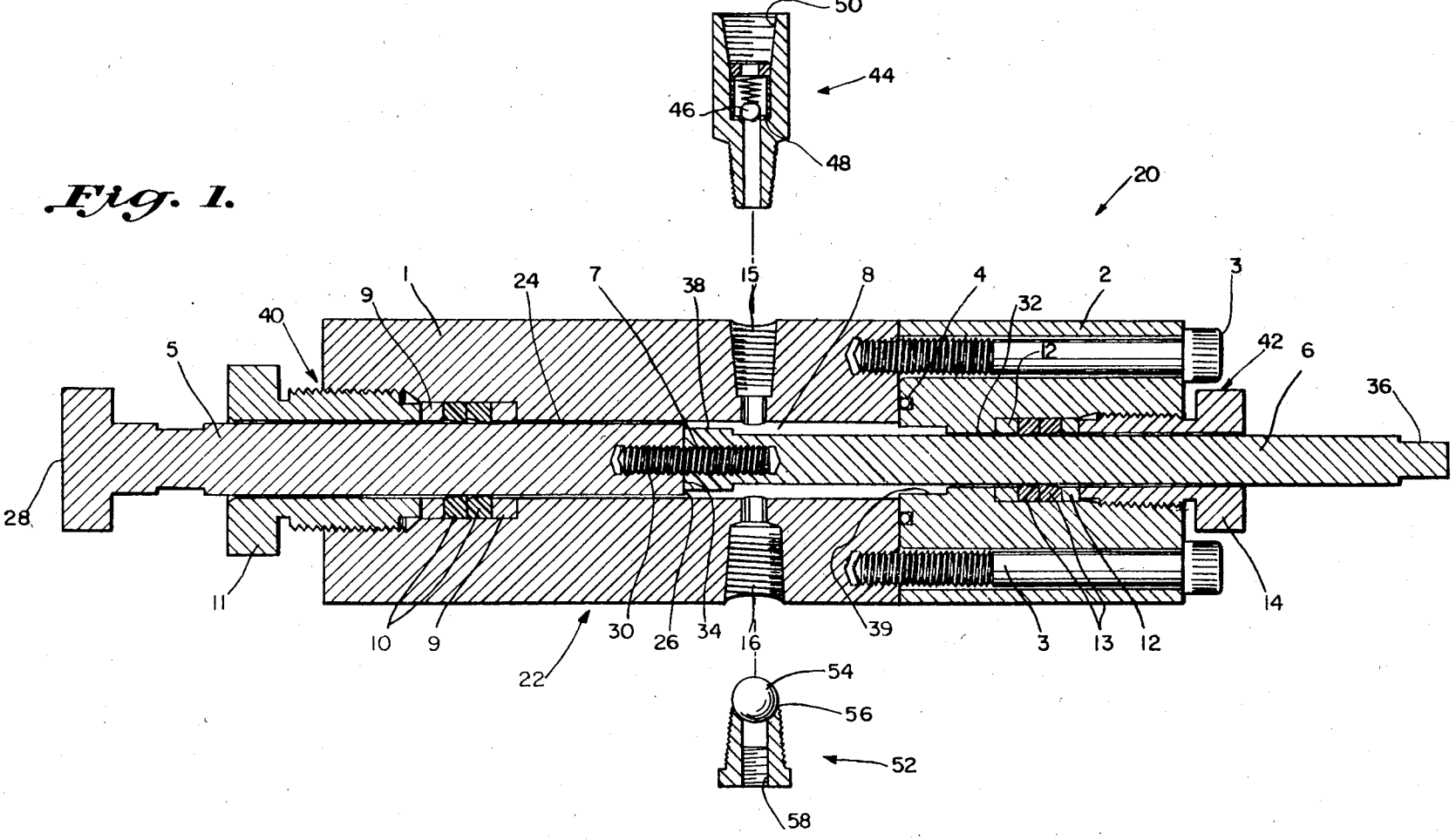
FIG. 1 is a cross-sectional view of a reciprocating plunger pump according to the present invention taken along the longitudinal axis thereof and showing the pump in a first mode of operation.
Figure 2:
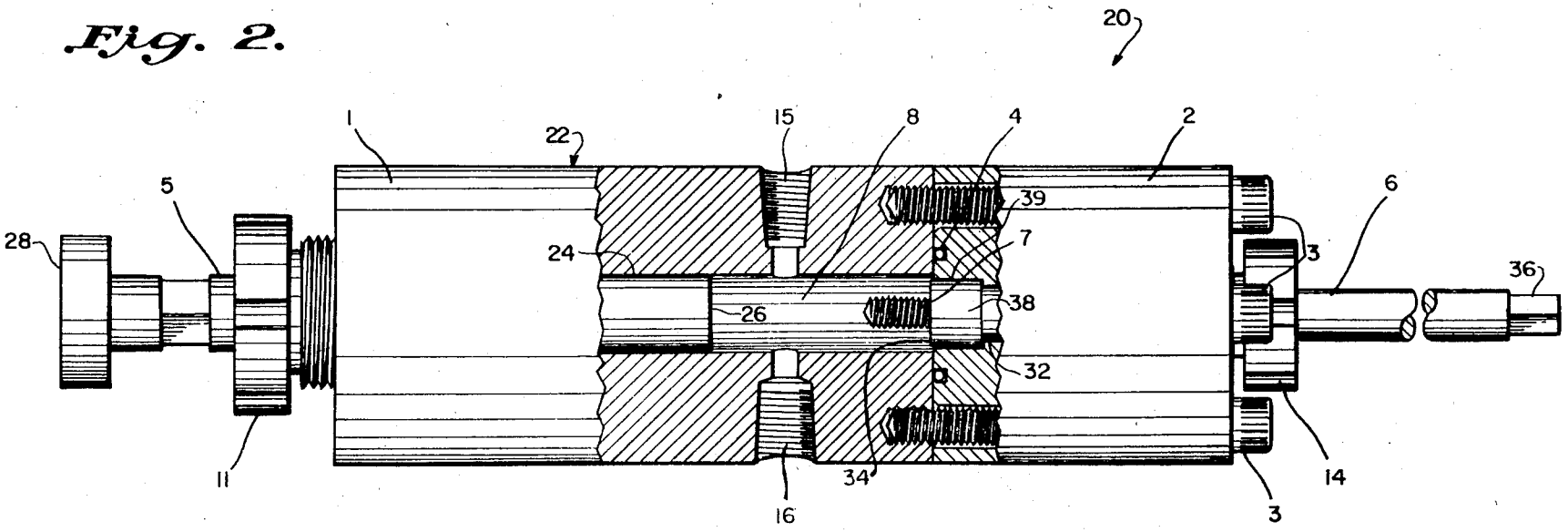
FIG. 2 is a partially broken-away view of the pump depicted in FIG. 1 showing a second mode of operation.

With reference now to the drawings in which like numerals represent like elements throughout the two views, a reciprocating plunger pump 20 according to the present invention is depicted in FIGS. 1 and 2. Reciprocating plunger pump 20 includes a substantially cylindrically shaped housing 22 formed by a main body 1 and a cap body 2. Cap body 2 is attached to main body 1 by bolts 3 which pass through cap body 2 and are threadably received in main body 1. An O-ring 4 is located in a suitable recess in cap body 2 so that an air-tight seal is provided between main body 1 and cap body 2.

Extending along the longitudinal axis of main body 1 is a cylindrical hole 24. Reciprocally mounted within hole 24 is a main plunger 5. Main plunger 5 includes a piston end 26 and an outer end 28. Outer end 28 is suitably adapted for connection to a motor (not shown)

which drives main plunger 5 in reciprocating motion. Piston end 26 of main plunger 5 includes a threaded hole 30 therein.

Located along the longitudinal axis of cap body 2 is a hole 32. Located in cylindrical hole 32 is an auxiliary plunger 6. Auxiliary plunger 6 includes an inner end 34 located inside housing 22 and an outer end 36 which extends beyond cap body 2. As shown best in FIG. 2, a screw 7 is received in inner end 34 of auxiliary plunger 6 and extends towards piston end 26 of main plunger 5. Inner end 34 of auxiliary plunger 6 includes an enlarged head 38. A recess 39 provided in cap body 2 receives head 38 as shown in FIG. 2.

As shown best in FIG. 2, the volume of hole 24 between piston end 26 and inner end 34 forms a pump chamber 8. In order to seal pump chamber 8 from atmosphere, sealing means 40 and 42 are provided about the peripheries of main plunger 5 and auxiliary plunger 6, respectively. Sealing means 40 includes junk ring bushings 9. Between junk ring bushings 9 are a pair of packing rings 10. A suitable packing nut 11 surrounds main plunger 5 and is threadably received in the outer end of main body 1 to exert a sealing force against junk ring bushings 9 and packing rings 10. Sealing means 42 includes similar junk ring bushings 12, packing rings 13, and packing nut 14.

Leading into and out of pump chamber 8 is a threaded outlet 15 and a threaded inlet 16. Threadably received in outlet 15 is a commercially available, standard check valve 44. Check valve 44 includes a spring biased ball 46 which engages a seat 48. The outer end of check valve 44 includes threads 50 to which a suitable hose (not shown) is connected to conduct the fluid pumped.

Received in inlet 16 is a commercially available, standard check valve 52 including a ball 54 which engages a seat 56. Check valve 52 is also provided with interior threads 58 so that a suitable hose (not shown) can be connected thereto to supply the fluid to be pumped to pump chamber 8.

The operation of reciprocationg plunger pump 20 is illustrated by way of the following example. In oil field operations, it is often necessary to hydrostatically test vessels or the like. In order to accomplish this, the vessel is initially filled with a suitable liquid, and the liquid is then placed under high pressure. Ordinarily, a single pump is used for this testing operation, and because a high pressure must ultimately be achieved, the pump must be a high pressure pump. As a result, although the pump produces a high pressure, it also correspondingly produces a low flow so that the time required to fill the test vessel is long.

With the present invention, reciprocating plunger pump 20 is used to relatively quickly test the desired vessel. Initially, reciprocating plunger pump 20 is assembled with an inlet fluid hose attached to threads 58 of inlet check valve 52 and an outlet hose attached to threads 50 of outlet check valve 44. The outlet hose is attached at the other end to the test vessel. Reciprocating plunger pump 20 is then operated in the mode depicted in FIG. 2 with auxiliary plunger 6 detached from main plunger 5. In this form, enlarged head 38 of auxiliary plunger 6 is located in recess 39. As the motor reciprocates main plunger 5, a suitable fluid is pumped into and out of pump chamber 8 and into the test vessel. This fluid is pumped at a relatively high volume and low pressure. However, at this point in the test it is only necessary to initially fill the vessel with the fluid and this is quickly done due to the high volume flow of reciprocating plunger pump 20.

After the test vessel is filled, reciprocating plunger pump 20 is stopped. Auxiliary plunger 6 is then grasped by outer end 36 and pushed into housing 22 until screw 7 engages threaded hole 30 and piston end 26 of main plunger 5. Outer end 36 of auxiliary plunger 6 is then rotated to advance screw 7 into main plunger 5. When screw 7 is securely received in main plunger 5, reciprocating plunger pump 20 is again operated. The operation of reciprocating plunger pump 20 in this mode of operation is depicted in FIG. 1.

As seen in FIG. 1, the reciprocation of main plunger 5 causes a similar reciprocation of auxiliary plunger 6. As auxiliary plunger 6 moves with main plunger 5, pump chamber 8 has been reduced in volume by the volume of auxiliary plunger 6 within pump chamber 8. Consequently, a much lower volume of fluid is pumped during each reciprocation of main plunger 5. The working area of piston end 26 of main plunger 5 has also been reduced by the presence of auxiliary plunger 6 to a small annulus. Assuming the same force is produced by the motor to reciprocate main plunger 5, this force is transferred to the fluid to be pumped about the area of the annulus of piston end 26 not covered by inner end 34. Thus, this force is transmitted to the relatively small volume within pump chamber 8 resulting in a very high pressure pumping of the fluid. As the test vessel is already filled with fluid, only a relatively small volume of high pressure fluid must be pumped into the test vessel to raise the pressure on the test vessel to the high value needed for the hydrostatic test.

By using the two modes of operation of reciprocating plunger pump 20, the hydrostatic testing of the vessel is quickly and efficiently achieved. Obviously, where a number of vessels must be tested, the time savings is significant.

In tests conducted with a reciprocating plunger pump 20 according to the present invention, a constant 100 psi air supply was supplied to the motor of the pump 20. A motor operating at 80 strokes per minute was attached to outer end 28 of main plunger 5. Then, using a main plunger 5 having a $\frac{3}{4}$ inch diameter, 0.306 GPM of fluid was pumped. The fluid supply stalled at 2800 psi. Next, auxiliary plunger 6 which had a diameter of $\frac{1}{2}$ inch was attached to main plunger 5. In this mode of operation, 0.170 GPM was pumped and the stall pressure occurred at 4900 psi. The stroke of the pump was 2 inches in both modes of operation.

It should also be appreciated that the two modes of operation of reciprocating plunger pump 20 can be combined with other means for varying the output of a reciprocating plunger pump so that the output of such a pump can be varied over a wide range of pressures and flows. Thus, with a motor which is capable of transmitting two different forces to the plunger of a reciprocating plunger pump, using such a motor with reciprocating plunger pump 20 results in four possible outputs varying according to pressure and flow. If the speed of the motor or the stroke length of the motor can also be varied, it is apparent that an even greater number of possible outputs varying in pressure and flow are possible. Thus, a wide range of outputs is provided by use of reciprocating plunger pump 20 with such a motor.

The wide range of outputs may be important where only a single motor is available at a work site even though a number of different pressure and flow conditions are needed or would be useful as a time-saving measure. For example, at an offshore oil production field, it may be necessary to pump chemicals downhole for well treatment to five different wells at varying pressures of 5000 psi to 11,000 psi. Ordinarily, only one pump would be available at this site and it would be adjusted to the highest pressure. Thus, when pumping into the lower pressure wells, the correspondingly low flow produced by the pump results in a longer shut down period than necessary with a resulting loss of production of the well during this time period. With reciprocating plunger pump 20, the variations in pressure and flow can result in a significant time savings and increase in production.

Although the present invention has been described with respect to an exemplary embodiment thereof, it will be understood by those of ordinary skill in the art that variations and modifications are possible within the scope and spirit of the invention.

I claim:

1. A reciprocating plunger pump having readily variable pumping modes comprising;

a pump housing including an enclosed pump chamber, a valved inlet to said pump chamber, a valved outlet from said pump chamber, a first plunger hole, and a second plunger hole having an enlarged recess adjacent a side of said pump chamber;

a first plunger located in said first plunger hole having a piston end extending into said pump housing and an outer end extending outside of said housing which is suitably driven, said first plunger being integrally formed and driven in a reciprocal motion in said first plunger hole of said housing along a reciprocationn axis that in a first pumping mode said first plunger alone produce a reciprocating pumping action in said pump chamber whereby a fluid is pumped into said pump chamber through said inlet and out of said pump chamber through said outlet;

a second plunger located in said second plunger hole having an inner end extending into said pump chamber through said recess and an outer end located outside of said pump housing, said inner end being slightly enlarged so as to be receivable in said recess and prevented from being pushed out of said second plunger hole, said second plunger being integrally formed and mounted for reciprocation along the reciprocation axis and for rotation about the reciprocation axis; and an attaching means for removably attaching said inner end of said second plunger to said piston end of said first plunger, said attaching means including (a) a screw projecting from said inner end of said second plunger along the reciprocation axis, (b) a threaded hole located in said piston end of said first plunger in which said screw is threadably received, and (c) an actuation means located exterior to said pump housing for actuating said attaching means, said actuation means including an adaptation on said outer end which is clear of said pump housing and all other pump elements such that said second plunger is easily gripped and rotated to engage and disengage said screw from said threaded hole and to locate said enlarged inner end of said second plunger in said recess when said inner end is disconnected from said piston end;

whereby the attaching of said second plunger to said first plunger in a second pumping mode results in a high pressure and low volume pumping of the fluid and the detaching of said second plunger from said first plunger in the first pumping mode results in a lower pressure and higher volume pumping of the fluid as said enlarged inner end is received in said recess of said pump chamber.

2. A reciprocating plunger pump as claimed in claim 1 wherein said plungers are substantially cylindrically shaped and the diameter of said piston end is greater than the diameter of said inner end.

3. A reciprocating plunger pump as claimed in claim 2 wherein said housing is generally cylindrically shaped and includes two mating cylindrical parts and a suitable attaching mean for holding the two parts together.

4. A reciprocating plunger pump as claimed in claim 2 wherein said valved inlet includes a check valve and said valved outlet includes a check valve.

5. A reciprocating plunger pump as claimed in claim 4 and further including sealing means for sealing the peripheries of each of said plungers, each said sealing means for a respective plunger including a pair of junk ring bushings which surround said plunger, a pair of packing rings located between said pair of junk ring bushings which surround said plunger, and a packing nut which surrounds said plunger adjacent one of said junk ring bushings and which is threadably received in said housing so as to exert a sealing force against said junk ring bushings and said packing rings.

* * * * *